US006854506B2

(12) United States Patent
Knott et al.

(10) Patent No.: US 6,854,506 B2
(45) **Date of Patent: *Feb. 15, 2005**

(54) PROCESS FOR PRODUCING SHAPED METAL PARTS

(75) Inventors: Wilfried Knott, Essen (DE); Benno Niedermann, Niederglatt (CH); Manfred Recksik, Essen (DE); Andreas Weier, Essen (DE)

(73) Assignee: Goldschmidt AG, Essen (DE)

( * ) Notice: Subject to any disclaimer, the term of this patent is extended or adjusted under 35 U.S.C. 154(b) by 57 days.

This patent is subject to a terminal disclaimer.

(21) Appl. No.: 10/146,701

(22) Filed: May 14, 2002

(65) Prior Publication Data

US 2002/0189779 A1 Dec. 19, 2002

(30) Foreign Application Priority Data

May 16, 2001 (DE) ..... 101 23 899

(51) Int. Cl.[7] ..... B22D 27/00; B22D 19/04
(52) U.S. Cl. ..... 164/79; 164/98; 164/113
(58) Field of Search ..... 164/79, 113, 98

(56) References Cited

U.S. PATENT DOCUMENTS 3,773,098 A * 11/1973 Rock ..... 164/79
4,713,277 A * 12/1987 Akiyama et al. ..... 428/131
4,852,630 A * 8/1989 Hamajima et al. ..... 164/76.1
5,992,500 A * 11/1999 Schneider et al. ..... 164/98

FOREIGN PATENT DOCUMENTS

| | | |
|---|---|---|
| DE | 195 02 307 A1 | 10/1995 |
| DE | 195 01 508 C1 | 4/1996 |
| DE | 297 23 749 U1 | 2/1999 |
| DE | 198 32 794 C1 | 10/1999 |
| GB | 892934 | 4/1962 |

OTHER PUBLICATIONS

Banhart et al. Wirtschaftliche Fertigungstechniken Für Die Herstellung Von Aluminiumschäumen; *Cost–effective Production Techniques for the Manufacture of Aluminum Foams*; Aluminum, 76 Jahrgang 2000, 6, pp. 491–496.
Kerbverschleiss, (s. Verschleiss), pp. 640–661.

* cited by examiner

*Primary Examiner*—Kuang Y. Lin
(74) *Attorney, Agent, or Firm*—Frommer Lawrence & Haug LLP

(57) ABSTRACT

The invention relates to a process for producing shaped metal parts, in particular reduced-weight shaped parts made from metallic materials. In this process, a metal body with a surface which is closed on all sides and a hollow structure in the interior is placed into a die as a core and is then surrounded with a metal melt by casting. The surface region of the metal body has a mean density which is higher than the interior of the metal body by a factor of 1.5 to 20.

12 Claims, 1 Drawing Sheet

PROCESS FOR PRODUCING SHAPED METAL PARTS

RELATED APPLICATIONS

This application claims priority to German application 101 23 899.1, filed May 16, 2001, herein incorporated by reference.

BACKGROUND OF THE INVENTION

1. Field of the Invention

The invention relates to a process for producing shaped metal parts, in particular reduced-weight shaped parts comprising light metal, and to the shaped parts produced using this process and their use in light metal structures.

2. Background of the Invention

In view of increased ecological demands, but also with a view to use within high-technology applications, such as aircraft construction, automotive engineering or in parts with high static demands, it is highly important to reduce the weight of shaped metal parts. In this context, in particular light metals are materials which ensure an ever wider range of applications. A further possible way of reducing weight is to use foamed metallic materials. The foams used are distinguished by a lightweight structure, rigidity, compressive strength, improved mechanical and acoustic damping, inter alia. The production of components from foamed metallic materials is also known.

GB 892934 relates to the production of complex structures with a foamed metal core and a closed, nonporous surface.

DE 198 32 794 C1 describes a process for producing a hollow profiled section which is filled with metal foam. This process comprises the steps of pressing the hollow profiled section from a cladding material by means of an extrusion press which has an extrusion die comprising a female mould and a mandrel, supplying the metal foam comprising a foam material to the hollow profiled section through a feed duct which is formed in the mandrel.

DE 297 23 749 U1 discloses a wheel for a motor vehicle which comprises at least one metallic foamed core which is arranged in such a manner that it is exposed on the inner side of the wheel and has a cast wall on the outer side of the wheel. For casting of the wheel, the foamed core of aluminum foam is placed into a chill mould and positioned in such a way that, during casting, the outer cast skin is formed between the chill mould and the foam core.

DE 195 02 307 A1 describes a deformation element, in the housing of which a filling comprising an aluminum foam as energy absorber is provided. The housing may consist of metal or plastic. The filling body is simply an insert part without any material-to-material bonding to the housing.

However, the use of casting cores made from metal foam is of particular interest for the production of internally foamed metallic shaped parts.

For example, DE 195 01 508 C1 claims a component for the chassis of a motor vehicle and a process for producing a component of this type. For this purpose, a core made from aluminum foam is introduced into a pressure die-casting die, and this core remains in the die-cast aluminum component after the aluminum has been forced into the die (lost core principle). The aluminum foam used is formed from a mixture of aluminum powder and a blowing agent and is produced in a manner known per se in a multistage process (a process of this type is described, for example, in the article "Wirtschaftliche Fertigungstechniken für die Herstellung von Aluminiumschäumen" [Economic manufacturing techniques for the production of aluminum foams], Aluminium, 76$^{th}$ volume 2000, pp. 491 ff). According to DE 195 01 508 C1, the foamed aluminum bodies produced in this way, having a density of 0.6 to 0.7 g per $cm_3$ and a closed porosity, are then placed into a die, with the core of foamed aluminum being supported or secured to the inner wall of the casting die at the locations which are subject to low loads, so that a uniform distance with a desired wall thickness is retained between the core and the die. Only by maintaining this distance between the core and the die is it possible to ensure that a closed, sufficiently stable wall is formed in the shaped part which is produced.

The process of fitting core supports in order to support cores in die cavities which is employed for this purpose has already long been part of standard practise in casting processes (cf. Giessereilexikon, 17$^{th}$ Edition 1997, Stephan Hasse, p.658 and pp. 640 ff.). Overall demands imposed on the cores which are to be used are not only that they must either be sufficiently pressure-stable for use in pressure die-casting processes or must be suitably temperature-resistant with respect to liquid or semiliquid metal for use in casting filling processes which proceed at a slow rate, so that their position in the die does not change and a part of the volume which they take up is not released again during the filling process, but also that they must satisfy the requirement for accurate supporting within the die cavity, which in some cases is highly complex. This can be recognised, for example, from the wide range of commercially produced core supports (cf. for example the delivery range of Phoebus Kemstützen GmbH & Co. KG, Dortmund) and also from the use of core-support adhesion units as auxillary means for fixing the core bodies in a die. However, in particular the use of core supports for the precise positioning of a core in a die leads to at some points very high pressures on the outer skin of the corresponding core bodies during the die-filling process. This is a problem, particularly in the case of reduced-weight foamed bodies, if foamed bodies of this type cannot be produced with precisely accurate dimensions and an outer skin of suitable stability, which is able to withstand the described temperature and pressure loads during the filling process, irrespective of whether or not core supports are used, is not formed at the same time.

OBJECTS OF THE INVENTION

Therefore, it is an object of the invention to solve the problem of reliably surrounding a weight-reduced foamed body by casting and to allow a process for the processing of metal bodies of this type to form shaped metal parts of reduced weight by further processing in a casting process.

SUMMARY OF THE INVENTION

Accordingly, the subject matter of the invention is a process for producing shaped metal parts, wherein metal bodies with a surface which is closed on all sides and a hollow structure in the interior are placed into a die and the remaining die cavity is then filled with a metal or a metal alloy.

DETAILED DESCRIPTION OF THE INVENTION

Figure 1:
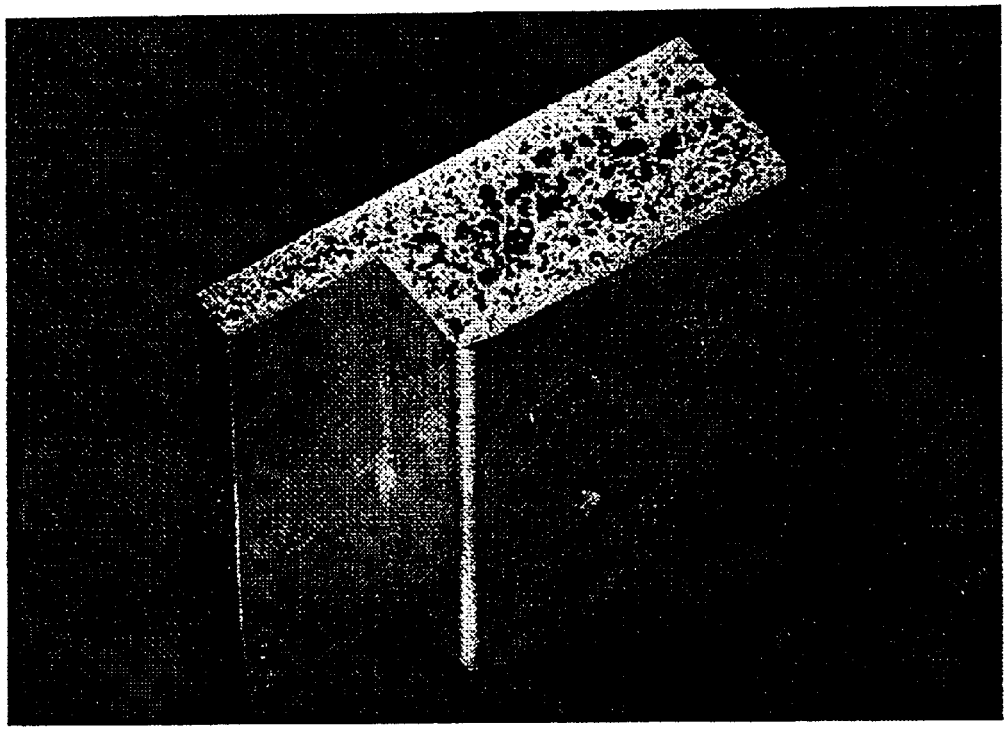
FIG. 1 depicts a cross-section through an integral shaped foam, which is suitable for use as a core.

In this process, the surface region of the metal body has a mean density which is higher than the interior of the metal body, as a preference, by a factor of about 1.5 to about 20, preferably about 3 to about 15, particularly preferably about 5 to about 10.

If the metal structure which surrounds the metal body (core) has a higher density than the mean density of the metal body used, the shaped part which is produced therefrom has a correspondingly reduced weight. If it has a substantially uniform density, there is of course no reduction in weight, but a material which may be relatively expensive can be produced at lower cost by imbedding a less expensive shaped body.

A suitable metal body is in particular a foamed metal core, which advantageously has an integral foam structure. The metal body is usually surrounded with a liquid metal melt by casting, and this may take place, for example, in a pressure die-casting machine.

It is also possible for the metal body to be surrounded by casting with metal in the partially solidified state, in accordance with the semi-solid casting process.

Depending on the geometry and desired or sought-after mechanical property of the shaped metal parts, it is, of course, also possible for a plurality of similar or different metal bodies to be surrounded by casting.

Light metals, in particular aluminum or aluminum alloys, are particularly suitable for the process according to the invention; the metals or alloys used for production of the shaped parts may differ from those used for the shaped bodies.

As has been stated above, it is preferable for the metal body used to be an integral shaped metal foam which, unlike the foamed bodies which have usually been described in the literature, does not have a uniform foam morphology along its cross section. The production of a metal body of this type is described in DE 101 04 339.2, entitled "Process for Producing Metal Foam and Metal Body Produced Using this Process" which corresponds to application U.S. Ser. No. 10/060,520, filed Jan. 30, 2002, and is herein incorporated by reference. Instead, it is a shaped foamed body which can be produced with accurate contours in the outer zones and the outer shell of which is close to the density of the metal or metal alloy used. This integral metallic foam therefore represents a true gradient material. In the interior of the shaped body, however, the density is reduced by the occurrence of gas bubbles, so that the mean density of the overall shaped body is below the theoretical density of the metal or metal alloy used (FIG. 1). In this case, the mean density per cubic millimeter of the outer millimeter layer of the shaped body is higher than the mean density in the interior of the shaped body by a factor of about 1.5 to about 20, preferably about 3 to about 5, particularly preferably about 5 to about 10. Shaped bodies of this type can be produced, for example, by a pressure die-casting process directly from the melt with the addition of a blowing agent. The thickness of the outer skin of the shaped body, and therefore the temperature and pressure stability, can be adapted according to the particular use by suitably varying the process parameters, while at the same time the accurate contours of the shaped body which is formed allow precise positioning during further processing. For example, the metal bodies which 7 are to be used according to the invention can be utilized to reduce the weight of a complicated metal casting by being used as cores which remain in the end product. Furthermore, however, it is also possible for cores of this type to be used, on account of their industrial production process, to reduce the cost of the finished bodies, since, firstly, they can be produced without difficulty and, secondly, can generally be produced from a less expensive material than the metal cladding which subsequently surrounds them. On account of their particularly good pressure and temperature stability, cores of this type can be used not only for very rapid processes, such as the pressure die-casting process, but also, of course, for slow processes, which therefore impose very high demands with regard to the thermal load on the core body. The result is a wide range of application areas, such as for example squeeze-casting, and even use in casting processes which operate with metals or metal alloys which are not completely liquid, such as for example thixo-casting (semi-solid metal casting).

The practically closed outer skin of the integral foamed shaped bodies which are to be used according to the invention also allows these bodies to be used in vacuum casting processes, since, given the quality of the surface which is formed, it is possible for the die to be evacuated during the process according to the invention for producing the finished body, without gas leaks from the interior of the core body having a continuous disruptive effect, with an associated reduction in the vacuum, being observed.

The integral foamed shaped core maybe introduced into the die used either manually or using other customary industrial processes, for example by robots. The subsequent surrounding by casting and thus the formation of the reduced-weight target workpiece may, on account of the temperature and pressure stability of the core body outer skin, quite easily also be carried out using metals or metal alloys which have a higher melting point or a higher processing temperature than the melting point of the core material. A process of this type, which provides for the use of high-melting cladding materials, even has the advantage that the outer surface of the core body is partially melted, and therefore an intimate metallic bond is formed between the core material and the surrounding shell material of the finished workpiece during the subsequent process of solidification of the end body. As is customary in industrial casting processes, inter alia the excellent pressure stability of the core bodies used means that further treatment of the final workpiece is generally not required. The invention is described in more detail below with reference to an exemplary embodiment.

A vehicle component made from an aluminum material is to be produced in a commercially available pressure die-casting machine as an integrally foamed metal body. For this purpose, in a first step a shot sleeve of a pressure die-casting machine was filled with a suitable quantity of molten metal. Magnesium hydride in powder form was added to the liquid metal as a foam-producing blowing agent in the closed shot sleeve. Virtually simultaneously, the mixture of blowing agent and molten metal began to be pushed into the die cavity. The die cavity was underfilled by a defined volume. The resulting turbulence results in intimate mixing in the die cavity and in the cavity being filled by the foaming process. The spray filling caused the metal at the die walls to solidify, forming a dense, homogeneous wall of the metal body, it was possible for both the wall thicknesses and the porosity, as well as the gradient of the porosity to be adjusted by varying process parameters.

The "shot" took place before the formation of the foam, and the foaming process took place "in situ" in the die cavity. Rapid foaming took place in the cold die. The component had a mass of only approx. 40% compared to conventional die castings made from the same material. The metal body which had been produced in accordance with the example was then introduced as a core into a larger die, and the die was closed. Then, the standard pressure die-casting process was used to force a metal melt out of the shot sleeve of the pressure die-casting machine into the die cavity. During this filling operation, the die cavity was completely filled, and excess metal was removed from the shot passage and the end of the shot chamber after cooling of the shaped body. The result of this process was a shaped part of reduced weight which, in the region of the inserted core body, had cavities, but corresponded to a casting in the region of the structures which were not filled by the core.

The section through the example of a metal body (FIGURE) clearly indicates the accurate matching of the contours in accordance with the die employed, as well as the differing morphology at the edges and in the interior of the shaped body, and also the pressure stability of the core in view of the shallow indentation trace of the ejector.

The shaped body produced in accordance with the example had a lower density and an improved vibration-absorption behavior than the corresponding solid comparison body.

The above description of the invention is intended to be illustrative and not limiting. Various changes of modifications in the embodiments described herein may occur to those skilled in the art. These changes can be made without departing from the scope or specification of the invention.

What is claimed is:

1. A casting process for producing shaped metal parts comprising a metal structure which surrounds at least one integral foamed metal body (core) with a closed surface, said process comprises placing said integral foamed metal body (core) into a die, which comprises a die cavity, and the filling in the die cavity with a metal or a metal alloy, wherein the casting process occurs in a high pressure die-casting machine.

2. The process as claimed in claim 1, wherein the surface region of the metal body (core) has a mean density which is higher than the interior of the metal body by a factor of about 1.5 to about 20.

3. The process as claimed in claim 1, wherein the surface region of the metal body (core) has a mean density which is higher than the interior of the metal body by a factor of 1.5 to 2.0.

4. The process as claimed in claim 1, wherein the metal surface region of the metal body (core) has a mean density which is higher than the interior of the metal body by a factor of about 3 to about 15.

5. The process as claimed in claim 1, wherein the surface region of the metal body (core) has a mean density which is higher than the interior of the metal body by a factor of about 5 to about 10.

6. The process as claimed in claim 1, wherein the metal structure which surrounds the metal body (core) has a higher density than the mean density of the metal body.

7. The process as claimed in claim 1, wherein the metal or the metal alloy is a liquid metal melt and a casting process is used to surround the metal body (core) with the liquid metal melt.

8. The process as claimed in claim 1, wherein the metal or metal alloy is in a semi-solid state and a semi-solid casting process is used to surround the metal body (core) with the metal or metal alloy in the semi-solid state.

9. The process as claimed in claim 1, which further comprises applying vaccum to the die after the metal body (core) has been placed in the die, but before the die cavity is filled the metal or the metal alloy.

10. The process as claimed in claim 1, wherein a plurality of similar or different metal bodies (cores) are placed into a die.

11. The process as claimed in claim 1, wherein the metal or metal alloy is a metal melt comprising a light metal.

12. The process as claimed in claim 1, wherein the metal is aluminum or the metal alloy comprises aluminum.

* * * * *

UNITED STATES PATENT AND TRADEMARK OFFICE

CERTIFICATE OF CORRECTION

PATENT NO. : 6,854,506 B2
DATED : February 15, 2005
INVENTOR(S) : Knott et al.

It is certified that error appears in the above-identified patent and that said Letters Patent is hereby corrected as shown below:

Title page,
Item [73], Assignee, add -- Buhler Druckguss AG -- as one of the assignees; and change "Goldschmidt AG" to -- Goldschmidt GmbH --.

Signed and Sealed this

Fourth Day of April, 2006

JON W. DUDAS
*Director of the United States Patent and Trademark Office*